US005845941A

United States Patent [19]

Fotedar

[11] Patent Number: 5,845,941

[45] Date of Patent: Dec. 8, 1998

[54] MULTI CLIP BINDER WITH UNIQUE CLIP POSITIONING

[76] Inventor: Shivi Fotedar, 263 Thousand Oak Dr., Atlantic Highland, N.J. 07716

[21] Appl. No.: 690,497

[22] Filed: Jul. 31, 1996

[51] Int. Cl.[6] ..... B42F 13/14

[52] U.S. Cl. ..... 281/45; 281/26; 402/77; 402/62; 402/73; 402/80 R

[58] Field of Search ..... 281/45, 22, 26, 281/50; 402/77, 62, 60, 26, 74, 73, 80 R, 80 P, 78, 79, 14, 15, 16, 75

[56] References Cited

U.S. PATENT DOCUMENTS

| | | | |
|---|---|---|---|
| 3,211,156 | 10/1965 | Dennis . | |
| 4,243,249 | 1/1981 | Goss | 281/45 X |
| 4,351,546 | 9/1982 | Cognata . | |
| 4,402,530 | 9/1983 | Daguerre . | |
| 4,493,058 | 1/1985 | Harris et al. | 281/45 X |
| 4,571,109 | 2/1986 | Lapertosa | 402/77 |
| 4,735,438 | 4/1988 | Demarest, Jr. . | |
| 4,950,097 | 8/1990 | Blumberg | 402/14 X |
| 5,472,238 | 12/1995 | Sato . | |
| 5,593,242 | 1/1997 | Mathias | 402/60 X |
| 5,658,014 | 8/1997 | Barker et al. | 281/45 |
| 5,667,322 | 9/1997 | Mucznik | 402/14 X |

*Primary Examiner*—Frances Han
*Attorney, Agent, or Firm*—Kenneth P. Glynn, Esq.

[57] ABSTRACT

A clip binder for holding paper which does not require damaging the material to be held within the clips. The clip binder has a front cover, a binder spine, a back cover and a pair of clips mounted on each end of the binder spine. The clips have a clip spine and two retainer walls which together define the jaws within which the paper is inserted. The clips are positioned perpendicularly to the binder spine such that the jaws face each other and are at right angles to the binder spine. The height of the retainer walls are constructed low so that the papers can be easily leafed through and without and fold back problems. In an alternative embodiment, the clips are slidably mounted to the binder spine. In yet another embodiment, the clips are rotatably mounted to the binder spine.

16 Claims, 5 Drawing Sheets

MULTI CLIP BINDER WITH UNIQUE CLIP POSITIONING

BACKGROUND OF THE INVENTION

1. Field of the Invention

The present invention relates in general to binders which hold stacks of papers, i.e. manuals, reports, presentations and the like. Specifically, the present invention provides a binder which does not require damaging the papers to be held. More specifically, the device provides an easy means for holding a report and leafing through the same.

2. Description of the Prior Art

The following patents describe other binders which attempt to hold stacks of paper.

U.S. Pat. No. 5,472,238 to Sato describes a complex mechanism for securing the paper at a corner thereof. The paper binder has a rectangular mount and a lever rotatably attached at one corner of the mount. It further includes a spring mechanism for permitting elastic upward movement of the free end of the lever. A pressing means is connected also to the spring means for securing paper disposed underneath the rectangular mount. It further provides for a locking means to maintain the paper within the rectangular mount.

U.S. Pat. No. 4,351,546 to Cognata describes a channel clip report binder. The channel clip report binder includes a triangular shaped channel clip and a cover sheet which has been hingedly folded to form a W shape. The cover sheet is attached to the channel clip and an incision is made at the apex of the construct. Paper is then inserted into the channel by sliding into the jaws of the clip.

U.S. Pat. No. 4,402,530 to

Daguerre describes a file folder which has spring type clips for holding a stack of papers. The front of the folder is provided with an opening such that the spring clips can be attached to the paper. The back cover of the binder is situated with a securing device so that the clip does not slip.

U.S. Pat. No. 4,735,438 describes a pocket sized portable book page holder for use with holding open small books having narrow pages joined together along a central binding. The page holder has a spine section from which extends on both sides thereof a pair of retainer sections. The retainer sections have elongated handles for opening the binder and in aiding in holding the book open.

Notwithstanding the above prior art, it is believed that the device and method set forth herein is neither taught nor rendered obvious.

SUMMARY AND OBJECTS OF THE INVENTION

The present invention is a clip binder which positions the clip such that it is easy to place the paper within the binder without damaging the paper and still allows the user to easily leaf through the bound papers.

The majority of binders that exist in the market require the user to punch holes in the paper and then place it within the binder. As a consequence, the papers have to be damaged in some way prior to binding. It also results in a non-aesthetically looking report, which when copied will show dark places where the holes were made. In addition, not all documents are formatted for placement of the holes and can thereby result in destroying important information. In addition, the user has to have available a 3 hole punch device to avail himself/herself of the binder. Other types of binders require that you have specialized covers with openings for the binding mechanism. This approach is very unaesthetic in appearance and promotes an unprofessional demeanor to the project. In addition, the angle at which the papers are bound also presents problems in keeping the report open to the desired page. Finally, some binder types are limited in the number of papers that can be held by the binder.

The present invention overcomes the problems associated with current binders. The binder of present invention does not require punching holes in the paper or imposing any other such damage on the paper. It can easily accommodate any amount of paper to be placed within a binder, i.e. it can be used for reports, manuals, and even telephone books. The binder is comprised of a front cover, a spine section, a back cover and a pair of clips or clamps positioned at opposite ends of the spine.

The clips used can be of the spring clip variety. That is, the clip has a spine and two retainers walls which together form the jaws of the clip. A pair of handles are rotatably attached to the ends of the retainers walls for opening the jaw, which is normally biased in a closed position. Alternatively, a clip can be used which has a spine having two retainers walls which are hingedly and springably attached thereto. As before the retainer walls and spine form a jaw into which the papers are placed. The retainer walls are attached to the spine with a spring/hinge mechanism which nominally places the retainer walls in a closed configuration. However, to open the jaw, the retainer walls are pulled apart to overcome the spring mechanism and lock into a plane equivalent with the spine, i.e. the retainer walls and spine form a straight line. After the papers are inserted, the jaws are pushed back together to clamp on the papers.

In either case, the positioning of the clip provides an advantage as opposed to other binders. The clip is placed at right angles with respect to the spine of the binder itself. As a result, this allows the spine portion of the clip to form a barrier for the paper to back up against and in addition, prevents the paper from getting damaged. Furthermore, the height of the retainer walls are constructed such that the papers can easily be leafed through without having the papers automatically fold back over the other pages when reading the same. The size of the binder and the clips can be constructed to hold any amount of paper.

In alternative embodiments of the device, the clips can be moved laterally along the spine of the binder so that the papers can be aligned on the binder itself and then the clip can be slid back and clamped to the paper. In yet another embodiment, the clip is hingedly attached to the spine of the binder. In this configuration, the clip can be rotated upward out of the binder, the papers can be aligned and the clip rotated back in and clamped onto the papers.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention is a clip binder which has clips positioned in an advantageous manner such that papers can be easily bound together without damage to the papers themselves. In addition, the placement and height of the clips allows the user to easily leaf through the bound papers. The size of the binder and the clips can be constructed to hold any amount of paper.

Conventional ring binders require the user to place holes in the documents to be bound. Not only does this create a non-aesthetically looking report, it also irreversibly damages the paper to be bound. Thereafter, when copying the punched papers, the positions of the holes are indicated by small dark circular portions. This destroys the nice appearance of the report. In addition, the present invention requires no external equipment as required by conventional ring binders.

Generally, the binder is comprised of a front cover, a spine section, a back cover and a pair of clips or clamps positioned at right angles on opposite ends of the binder spine.

Figure 1:
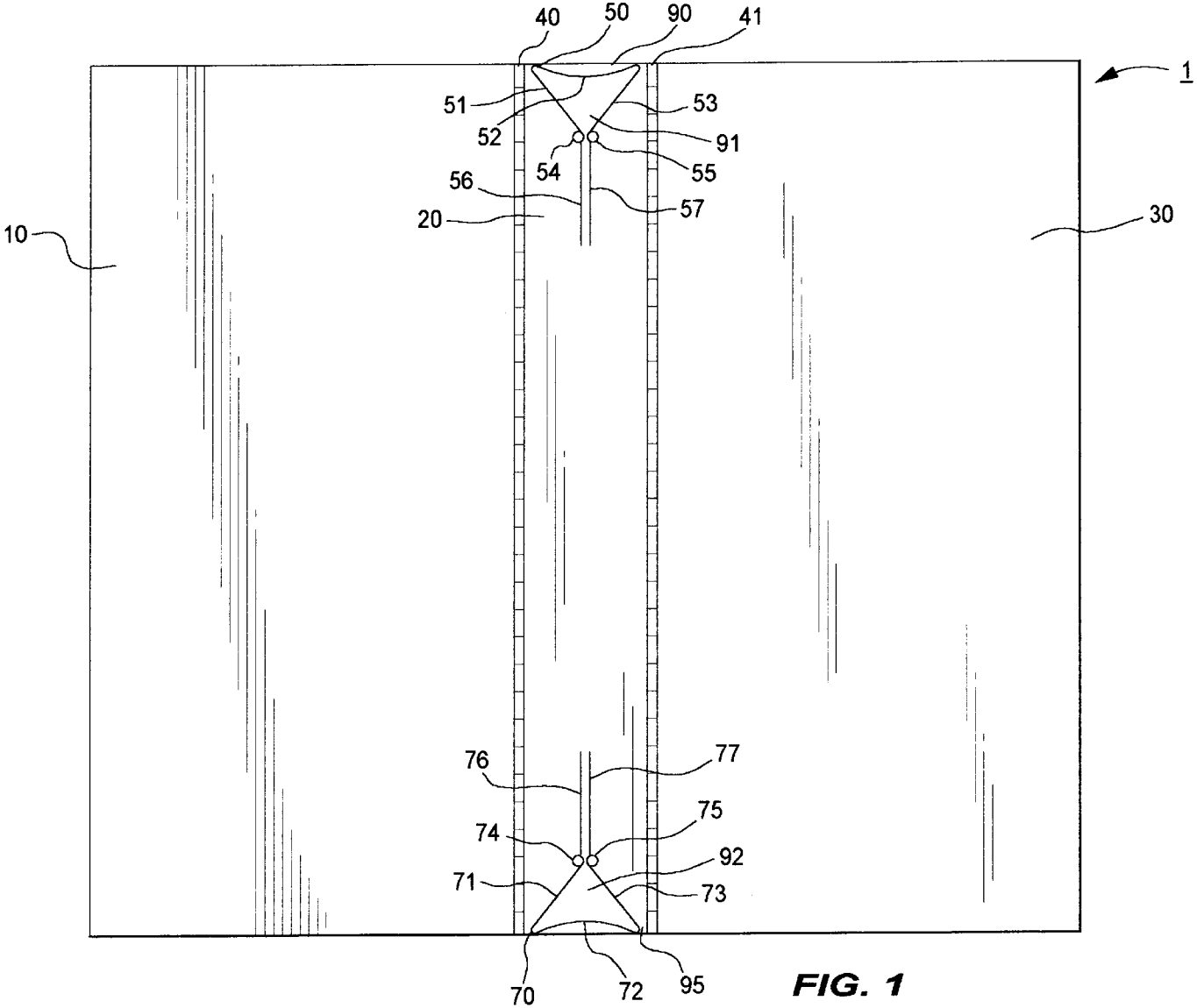
FIG. 1 shows a top view of an embodiment of the present invention.

Referring to FIG. 1, a binder of the present invention is generally depicted as 1. Binder 1 has a front cover 10, a binder spine 20, a back cover 30 and a pair of clips 50 and 70. Front cover 10, binder 20 and back cover 30 can be integrally, unistructurally formed with hingeable creases 40 and 41. These pieces can be constructed from a variety of materials which include but is not limited to plastics, metals, and combinations thereof. Alternatively, hingeable creases 40 and 41 can be hinges which attach separate front cover 10, binder spine 20 and back cover 30 together.

Binder spine 20 has opposing ends 90 and 95. Opposing ends 90 and 95 each have a clip 50 and 70, respectively. Clips 50 and 70 are positioned at right angles with respect to binder spine 20 (i.e. clips 50 and 70 are perpendicularly positioned with respect to binder spine 20). In other words, a pair of jaws 91 and 92 (explained below) are perpendicular to binder spine 20 such that paper can be slid in and out of jaws 91 and 92. By positioning clips 50 and 70 in this manner, certain features can be taken advantage of with respect to clips 50 and 70. This is further detailed below.

Figure 3:
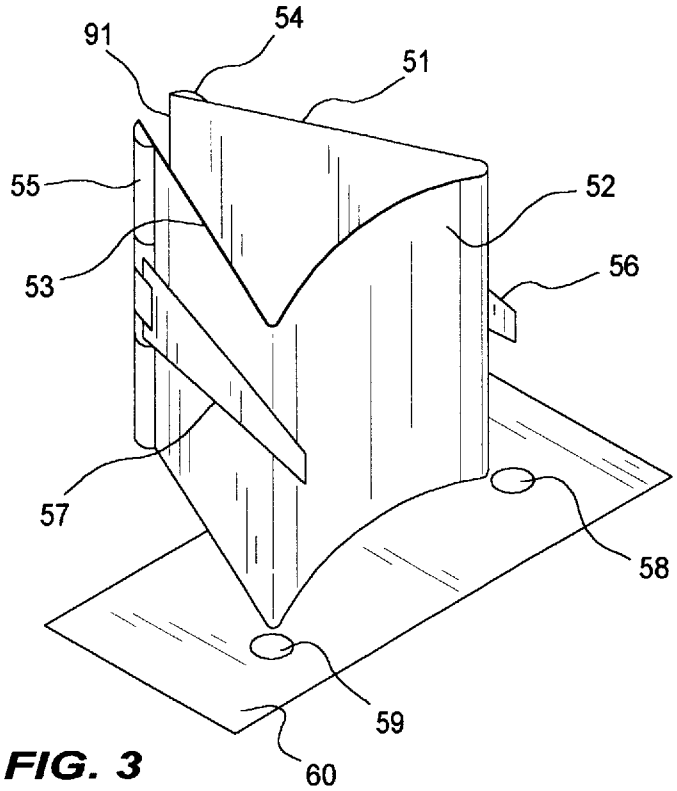
FIG. 3 shows an exploded rear view of the embodiment shown in FIG. 1.
Figure 2:
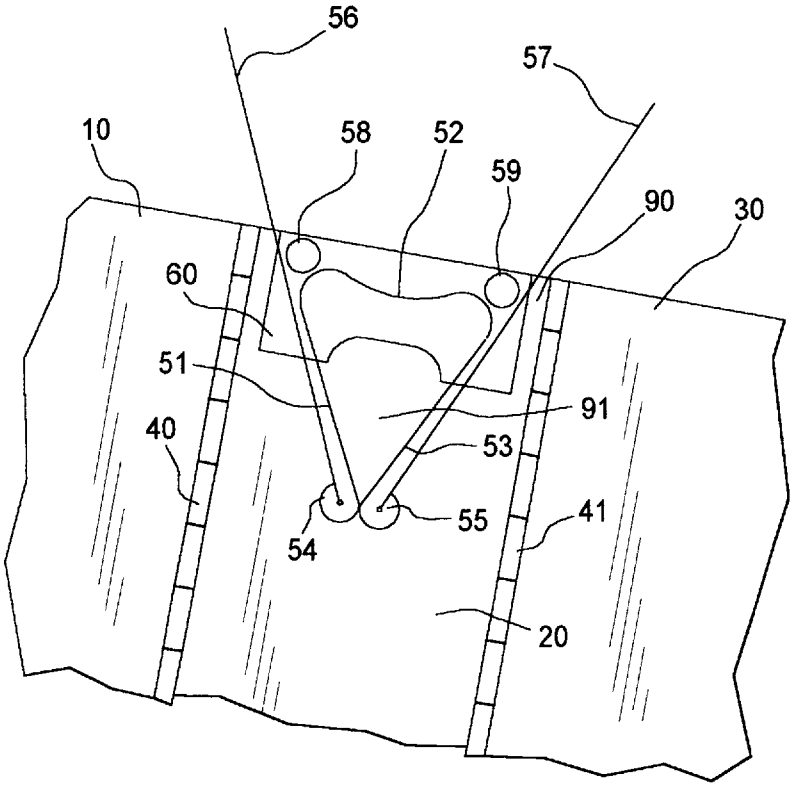
FIG. 2 shows an exploded top view of the embodiment shown in FIG. 1.

Referring now also to FIGS. 2 and 3, clips 50 and 70 are shown in more detail. Only clip 50 is referred to in the explanation, but it is understood that it is applicable to both clips 50 and 70. Clip 50 has a pair of retainer walls 51 and 53, and a clip spine 52 which together define a pair of jaws 91 and 92. Retainer walls 51 and 53, and clip spine 52 are constructed such that jaw 91 is biased in a closed configuration. In this embodiment, retainer walls 51 and 53, and a clip spine 52 are integrally, unistructurally formed, and is nominally constructed from metal. Retainers walls 51 and 53 further have arms 56 and 57 connected via a hinge mechanism 54 and 55, respectively. Clips 50 and 70 can be attached to binder spine 20 via any conventional means and in this embodiment is attached as shown in FIG. 3.

Referring now to FIGS. 2 and 3, clip spine 52 is elastically connected to a base 60. From another perspective, retainer walls 51 and 53 are not elastically connected to base 60. This allows clip spine 52 to compress as required when arms 56 and 57 force clip 50 to an open position. Base 60 is then attached to binder spine 20 via fasteners 58 and 59. Fasteners 58 and 59 can be any of a variety of commercial devices, which remain flush with base 60 when base 60 is connected to binder spine 20. Alternatively, binder spine 20 and clips 50 and 70 can be unistructurally formed and later attached to front cover 10 and back cover 30.

Figure 4:
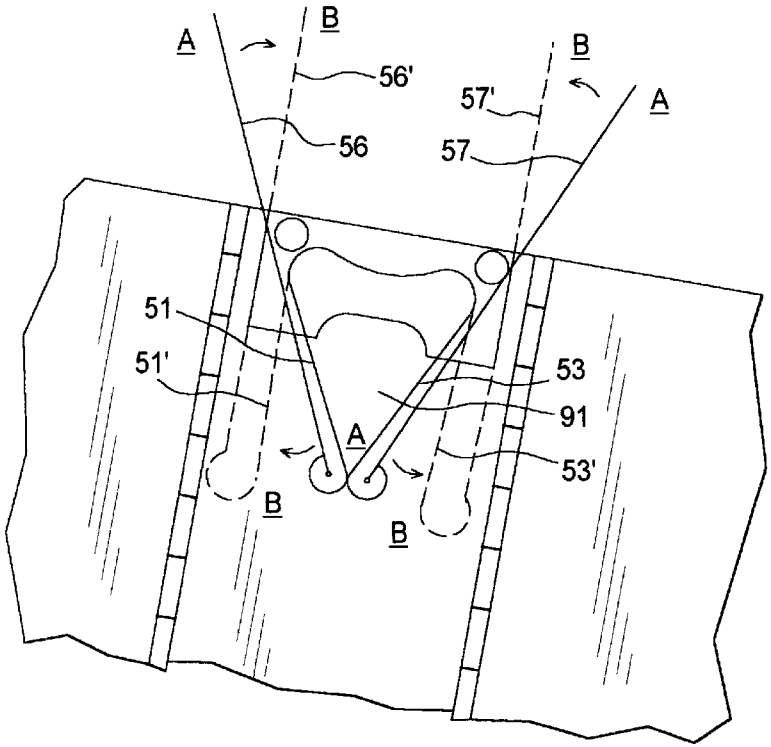
FIG. 4 shows a first and second position of the embodiment shown in FIG. 1.

Referring now also to FIG. 4, the functional and operational advantages of the present invention are described. As stated, jaw 91 is biased for a closed configuration and is represented by the indicia A. In an open configuration (as indicated by B), arms 56 and 57 are pressed together and moved towards dashed arms 56' and 57'. This causes retainer walls 51 and 53 to move to dashed retainer walls 51' and 53'. At this time paper(s) can be inserted into jaw 91. After which, the user allows arms 56 and 57 to move back toward their original positions, thereby allowing retainer walls 51 and 53 to clamp down on the papers. This is then repeated for the other end.

The placement of clips 50 and 70 at right angles to binder spine 20 takes advantage of certain features of clips 50 and 70 and binder 1 itself. First, this positioning allows the use of clip spine 52 as a back rest against which the bound papers can lie. This aids in keeping the bound papers aligned and in addition, it prevents the papers from getting damaged. Furthermore, the height of retainer walls 50 and 70 are constructed such that the papers will lie open to the desired pages and not fold back over. Further advantages of this positioning are illustrated in the embodiments discussed below.

Figure 5:
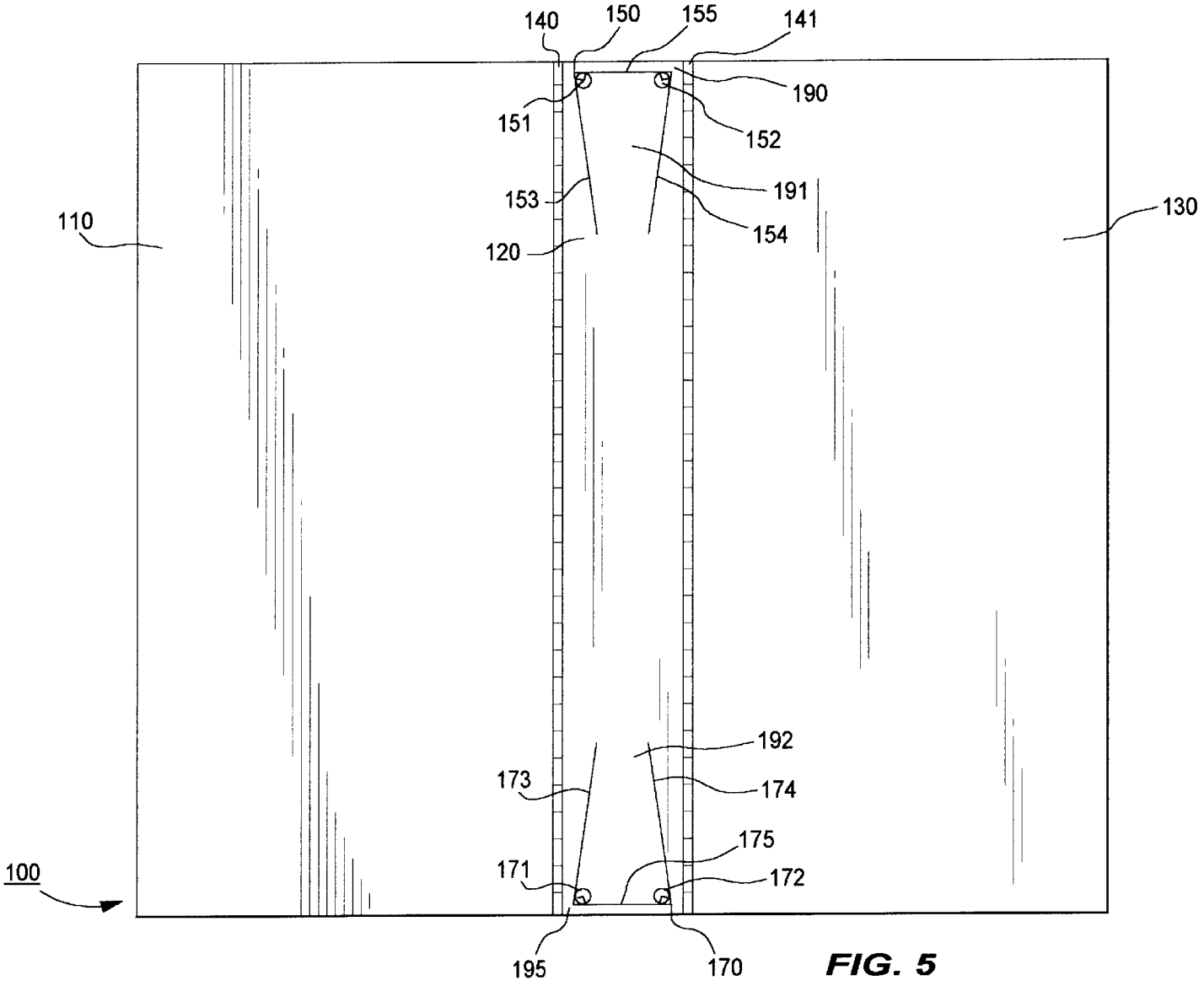
FIG. 5 shows a preferred embodiment of the present invention.

Referring now to FIG. 5, a preferred embodiment of the present invention is depicted generally as 100. As before clips 150 and 170 are strategically positioned on opposing ends 190 and 195. Also as before, only clip 150 is described in detail. Clip 150 has a pair of retainer walls 153 and 154 and a clip spine 155 which together define a pair of jaws 191 and 192 (for clip 170). The height of retainer walls 153 and 154 are designed low and/or narrow to permit easy leafing through of a bound set of papers. Alternatively, retainer walls 153 and 154 can be narrowly, tapered out from clip spine 155. Retainer walls 153 and 154 are springably and hingeably connected to clip spine 155 such that jaw 191 is biased in a closed position. This is accomplished via hinge/spring mechanisms 151 and 152, which in addition, attach clip 150 to binder spine 120.

Functionally, clip 150 is opened from its nominally biased closed position by pulling outwardly on retainer walls 153 and 154 until retainer walls 153 and 154 are in linear alignment with clip spine 155. That is, retainer walls 153 and 154 and clip spine 155 form a straight line. At this time, the user can align the documents to be bound on binder spine 120 itself, slide it within jaw 191, and press together retainer walls 153 and 154 such that the paper is between the same. This is then repeated for the clip 170. Since the height of retainer walls 153 and 154 are designed low enough to permit leafing through of the bound papers without having the pages fold back over, the use of the above clip has the simplest design for accomplishing the same. Since it is easy and straightforward, it can be manufactured at low costs.

Figure 8:
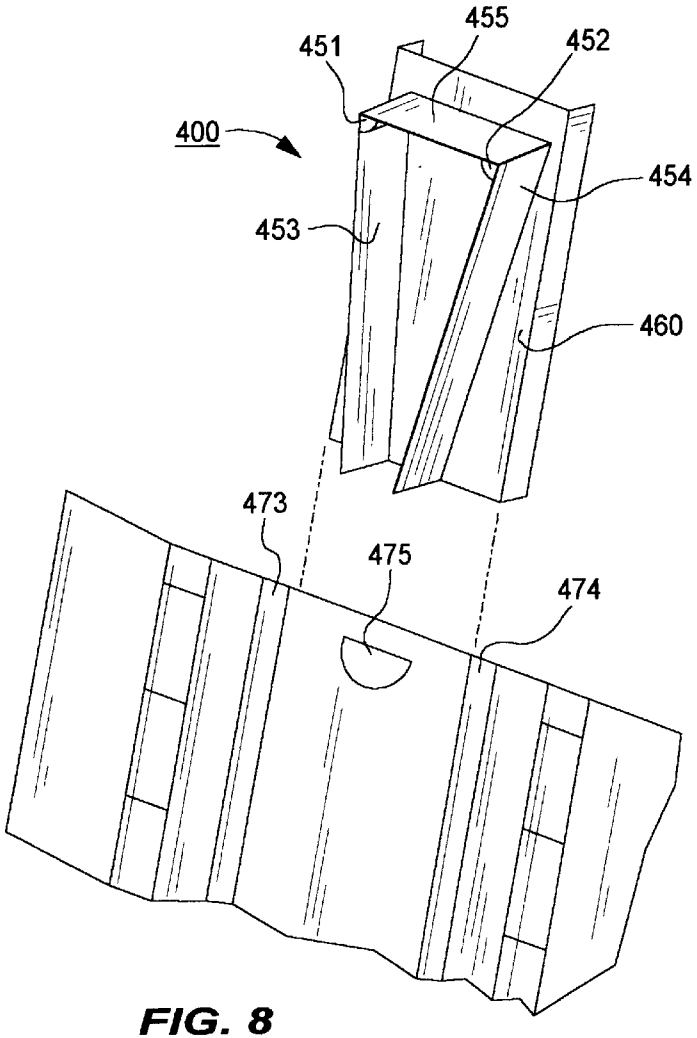
FIG. 8 shows still yet another embodiment of the present invention.
Figure 6:
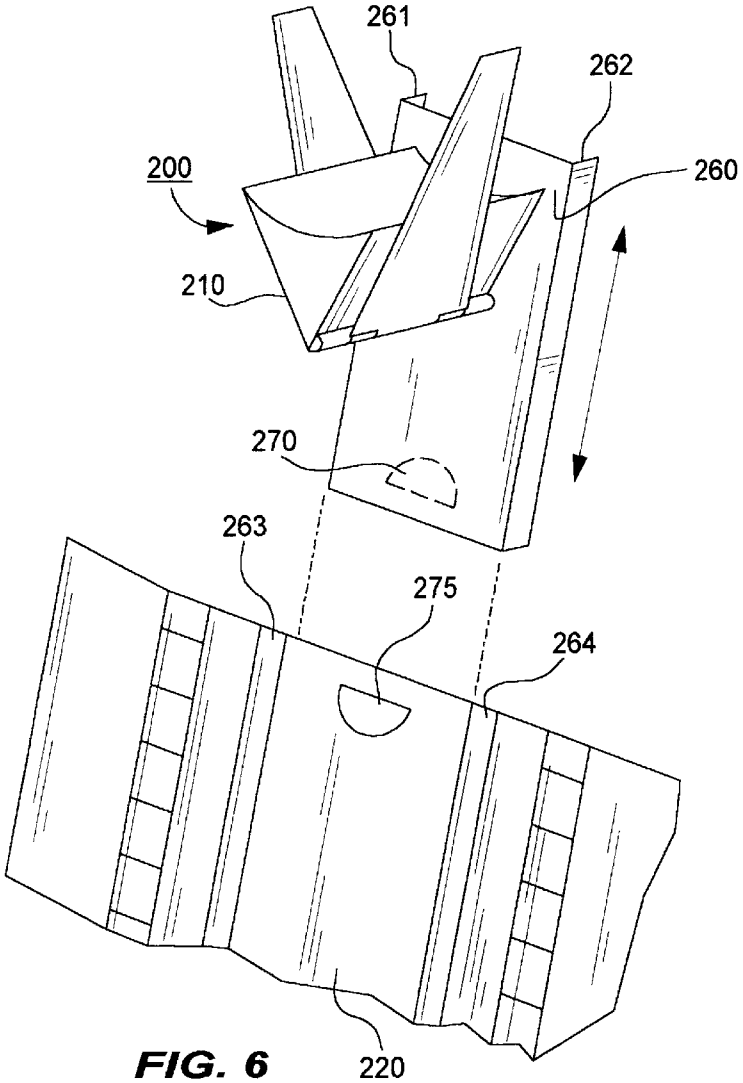
FIG. 6 shows an alternative embodiment of the present invention.

Alternative embodiments of the invention are now presented which allow the user to align the paper and move the clip into place without moving the aligned paper. Referring now to FIG. 6, an alternative embodiment of the present invention is shown and is depicted generally as 200. In this embodiment, clip 210 is slidably mounted to binder spine 220. Clip 210 is attached to base 260 as described before. However, base 260 now includes track rails 261 and 262 which engage track grooves 263 and 264 on binder spine 220. Base 260 further includes a catch mechanism 275 which is designed to engage a catch mate 270 so that base 260 does not slide off of binder spine 220. Catch mechanism 275 and catch mate 270 can be accomplished using a variety of available devices. The advantage of this embodiment is that it allows the user to align the papers on binder spine 220 and then simply slide clip 210 to clamp all of the papers. The aligned papers themselves do not have to be moved, thus making this design very simple, easy and efficient to use. It results in a very aesthetically pleasing report and the like, which can be easily copied without any visible marks. Referring now to FIG. 8, a similar embodiment is shown but using the clip design of FIG. 5.

Figure 7:
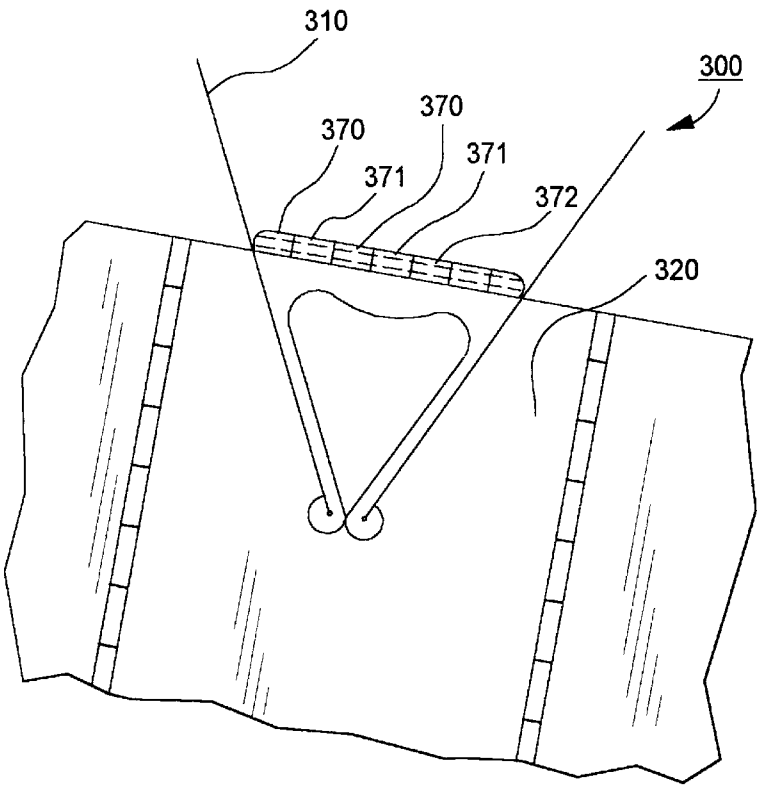
FIG. 7 shows yet another embodiment of the present invention.

Referring now to FIG. 7, a still further embodiment is shown and is generally designated 300. In this embodiment, clip 310 is hingedly mounted on binder spine 320. This approach also provides an easy and efficient method for binding a group of papers. Clip 310 is hingedly connected to binder spine 320 via hinge mechanism 370. Clip 310 has a first hinge member 370 and a binder spine 320 has a second hinge member 371 which is connected together with a hinge pin 372. Functionally, clip 310 is opened and rotated outwardly and upwardly from binder 300. The user then aligns the paper as before and clip 310 is then rotated and pressed together to bind the papers.

Although in the above embodiments a front and back cover are included, it should be apparent that neither is needed for operation of the present invention. Both the front cover and back cover could be bound along with the papers, i.e. plastic or other types of cover sheets could be used on the top and bottom of the papers to be bound.

A further embodiment of the present invention uses a release mechanism to open the clips to an open position, thereby simplifying the operation. The release mechanism is connected to both of the clips such that when it is triggered, both of the clips are in an open position simultaneously, and both clips can receive and clamp the paper. In other words, it is a one trigger, dual clip release mechanism. The release mechanism would normally be in a closed position, which in turn corresponds to the closed clip position. This embodiment relieves the user from opening each clip independently prior to clipping the paper within it.

Obviously, numerous modifications and variations of the present invention are possible in light of the above teachings. It is therefore understood that within the scope of the appended claims, the invention may be practiced otherwise than as specifically described herein.

What is claimed is:

1. A clip binder for holding paper, which comprises:

a) a front cover, a binder spine, a back cover hingeably connected to one another, and a means for hingeably connecting said front cover to said binder spine and said binder cover to said back cover;

b) said binder spine having opposing ends;

c) a pair of clips connected to said binder spine;

d) said pair of clips each having a pair of retainer walls and a clip spine together defining a pair of jaws for holding the paper; and e) means for positioning one of said pair of clips perpendicularly to one of said opposing ends and another of said pair of clips on a remaining one of said opposing ends such that each of said pair of jaws are facing each other and a flat surface of each of said clip spines are facing each other and are at substantially right angles with said binder spine and wherein each of said clip spine is positioned at substantially right angles with said binder spine and extending upwardly therefrom;

wherein said pair of clips constitutes a top clip and a bottom clip and said clip spine of said top clip acts as a rest stop against which a top edge of paper lies and said clip spine of said bottom clip acts as a rest stop against which a bottom edge of paper lies, when the paper is inserted and bound within said pair of jaws of said top clip and said bottom clip.

2. The clip binder of claim 1, wherein a height of said retainer walls is constructed low so as to permit leafing through of the papers and so as to prevent fold back.

3. The clip binder of claim 1, wherein said pair of retainer walls further comprises:

a) a pair of arms; and b) one of said pair of arms hingeably connected to one of said pair of retainer walls and a remaining one of said pair of arms hingeably connected to a remaining one of said pair of retainer walls;

wherein said pair of arms is used to open said pair of jaws.

4. The clip binder of claim 1, wherein said pair of jaws are biased in a closed configuration.

5. The clip binder of claim 1, wherein said means for positioning further includes a means for slidably connecting at least one of said pair of clips to said binder spine.

6. The clip binder of claim 5, wherein said at least one is two.

7. The clip binder of claim 6, wherein said pair of jaws are biased in a closed configuration.

8. The clip binder of claim 7, wherein a height of said retainer walls is constructed low so as to permit leafing through of the papers and prevent fold back.

9. A clip binder for holding paper, which comprises:

a) a front cover, a binder spine, a back cover and a means for hingeably connecting said front cover to said binder spine and said binder cover to said back cover;

b) said binder spine having opposing ends;

c) a pair of clips;

d) said pair of clips each having a pair of retainer walls and a clip spine together defining a pair of jaws for holding the paper; and e) means for positioning one of said pair of clips perpendicularly to one of said opposing ends and another of said pair of clips on a remaining one of said opposing ends such that said pair of jaws are facing each other and are at substantially right angles with said binder spine and wherein said clip spine is positioned at substantially right angles with said binder spine and extending upwardly therefrom;

wherein said means for positioning further includes a means for hingeably connecting at least one of said pair of clips with said binder spine such that said at least one of said pair of clips is rotatable outward and inward with respect to the clip binder.

10. The clip binder of claim 9, wherein said at least one is two.

11. The clip binder of claim 10, wherein said pair of jaws are biased in a closed configuration.

12. The clip binder of claim 11, wherein a height of said retainer walls is constructed low so as to permit leafing through of the papers and prevent fold back.

13. A clip binder, which comprises:

a) a binder spine;

b) said binder spine having opposing ends;

c) a pair of clips;

d) said pair of clips each having a pair of retainer walls and a clip spine together defining a pair of jaws for holding the paper; and e) means for positioning one of said pair of clips perpendicularly to one of said opposing ends and another of said pair of clips on a remaining one of said opposing ends such that said pair of jaws are facing each other and are at substantially right angles with said binder spine and wherein said clip spine is positioned at substantially right angles with said binder spine and extending upwardly therefrom;

wherein said binder spine further includes a means for hingeably connecting a front cover and a back cover; and, wherein said means for positioning further includes a means for hingeably connecting at least one of said pair of clips with said binder spine such that said at least one of said pair of clips is rotatable outward and inward with respect to the clip binder.

14. The clip binder of claim 13, wherein said means for positioning further includes a means for slidably connecting at least one of said pair of clips to said binder spine.

15. The clip binder of claim 13, wherein a height of said retainer walls is constructed low so as to permit leafing through of the papers and prevent fold back.

16. The clip binder of claim 15, wherein said pair of jaws is biased to a closed position.

* * * * *